US006454002B1

(12) United States Patent
Stokes et al.

(10) Patent No.: US 6,454,002 B1
(45) Date of Patent: Sep. 24, 2002

(54) METHOD AND APPARATUS FOR INCREASING PRODUCTION FROM A WELL SYSTEM USING MULTI-PHASE TECHNOLOGY IN CONJUNCTION WITH GAS-LIFT

(75) Inventors: Edward G. Stokes, Katy, TX (US); Marshall H. Mitchell, Carencro, LA (US); Dennis T. Perry, Houston, TX (US)

(73) Assignee: Conoco Inc., Houston, TX (US)

( * ) Notice: Subject to any disclaimer, the term of this patent is extended or adjusted under 35 U.S.C. 154(b) by 13 days.

(21) Appl. No.: 09/703,762

(22) Filed: Nov. 1, 2000

(51) Int. Cl.[7] ..... E21B 34/00
(52) U.S. Cl. ..... 166/250.15; 166/372; 166/53
(58) Field of Search ..... 166/250.08, 250.15, 166/372, 53; 73/861.04

(56) References Cited

U.S. PATENT DOCUMENTS 4,685,522 A * 8/1987 Dixon et al. ..... 166/372
5,211,848 A 5/1993 Tuss et al. ..... 210/87
5,934,371 A * 8/1999 Bussear et al. ..... 166/53
6,266,619 B1 * 7/2001 Thomas et al. ..... 702/13

OTHER PUBLICATIONS

Article titled: "Application of the First Multi Phase Flowmeter in the Gulf of Mexico", Authors: Edward G. Stokes, Dennis T. Perry and Marshall H. Mitchell; Publication: Society of Petroleum Engineers II SPE 49118, pp. 361–369.

* cited by examiner

*Primary Examiner*—William Neuder
(74) *Attorney, Agent, or Firm*—Madan, Mossman & Sriram, P.C.

(57) ABSTRACT

An apparatus and method are provided to improve production from a gas-lift well comprising injecting gas into a well to lift multi-phase formation fluid from the well; measuring at least one characteristic of the multi-phase formation fluid with a multi-phase flow meter while the fluid is in multi-phase form determining a value of the at least one characteristic from the measurement and adjusting at least one injection gas characteristic based on the determined value, the adjustment tending to improve well system production.

28 Claims, 3 Drawing Sheets

METHOD AND APPARATUS FOR INCREASING PRODUCTION FROM A WELL SYSTEM USING MULTI-PHASE TECHNOLOGY IN CONJUNCTION WITH GAS-LIFT

BACKGROUND OF THE INVENTION

1. Field of the Invention

The present invention pertains to a method and system for monitoring the operation of one or more gas-lift fluid production wells and improving production from such wells.

2. Description of the Related Art

It is not uncommon for the reservoir pressure in typical oil wells to be insufficient to cause a produced fluid to flow naturally from the well. In such situations, the produced fluid (usually a multi-phase fluid containing gas, oil and water) must be artificially raised to the surface, and the typical methods currently used to artificially raise the fluid are submersible or beam pump and gas-lift. Submersible and beam pumping as well as gas-lift are applicable to surface facility forms (onshore on platforms). Beam pumping is not applied to sub-surface well applications. In deep wells, beam pumping is not routinely used because the extensibility of sucker rods used for pumping deprives the pump of a sufficient stroke. In such cases, gas-lift is often used when there is sufficient gas-lift gas available. In gas-lift methods of production, a production tubing string is installed within the cased opening. Production is attained through this production tubing. The annulus outside the production string, but within the cased hole, is used as the downward path for communication of gas, which is used by the gas-lift equipment. The process consists of forcing (compressing) gas under high pressure into the annulus. At the gas-lift equipment, gas is introduced into the production or tubing string to reduce the density of petroleum liquid produced from a deep formation so that the liquid will rise in the production tube. Hence, gas-lift valves located in side pocket mandrels are installed at various elevations within production tubing, and are adjusted in depth to reduce hydrostatic pressure. The lower the gas-lift valve the more liquid is lifted in the well.

Even though the reservoir pressure may not be sufficient to raise the produced fluid to the surface it will normally be sufficient to support a column of fluid within the tubing. The lift gas may be injected continuously or intermittently depending upon the rate at which the produced fluid, under the action of the reservoir pressure, flows into the tubing. If the reservoir pressure is sufficient to maintain continuous flow into the tubing, continuous injection of gas will cause the produced fluid-gas mixture to continuously flow to the surface of the well. If the reservoir pressure is insufficient to cause the continuous flow of produced fluids from the formation through the casing perforations and into the tubing string, intermittent gas injection at appropriate times may be the only efficient method of gas-lifting the fluid to the surface. Intermittent injection of high-pressure gas into the tubing string will cause the fluid column, or slug, which has accumulated over some period of time, to be propelled to the surface almost as if the fluid constituted a cohesive mass.

Typical methods for determining the characteristics of production fluid gas include flowing multi-phase production fluid through a test separator. The test separator separates the multi-phase fluid. Single-phase meters are then used to measure each of the separated gas, oil and water streams. A drawback of using test separators is the enormous expense of weight support and space required associated with the test equipment its installation and operation, especially when located on offshore operations. In offshore production systems, the test separator is typically installed on a platform. However, technology in deep water production systems is moving toward requiring subsea placement of the separator where maintenance costs will be high.

Injection gas adjustments based on the averaged measurements severely impact production rates with respect to the actual flowing conditions of the well. A drawback of current gas-lift well methods is that control systems used to vary injection gas rates do not have timely data upon which to base control decisions. There are considerable dead time and time lag in the measurements that present difficult control problems. Accurate real-time measurements regarding the rate and type of produced fluid (e.g. gas, oil and water) and the flow regime is not available in the typical system for varying the injection gas characteristics. Typically, rate is the injection gas characteristic varied.

Under current methods, determining the characteristics of the produced fluid are based on measuring the output of multi-phase flow through a test separator with single-phase meters to measure each of the separated gas, oil and water streams. In the typical system, a production tube leads to a manifold which is switchable between the test separator and an output production tube. It can take anywhere from 4 to 12 hours to test produced fluid to obtain useful data values. These volumetric rate measurements are time averaged due to the time required to make the determinations. As a consequence, the values are average values. These late and averaged values make it impossible to determine real-time dynamic characteristics of the well being tested. Therefore the operator cannot make incremental or real-time adjustments to the injection gas in order to improve well production. Additionally, test separators are not generally placed on every well. A characteristic of the produced fluids can change over time more rapidly than the measurements are completed.

SUMMARY OF THE INVENTION

The present invention solves the problems identified above by providing an apparatus and method for improving production from a gas-lift well including determining certain properties of the produced formation fluid flowing through the production tubing without separating the fluid, and making injection gas adjustments based on real-time multi-phase measurements.

According to one aspect of the invention, a method of improving production from a gas-lifted production well system including one or more interconnected wells comprises injecting gas into a well to lift formation fluid from the well; measuring at least one characteristic of the formation fluid with a multi-phase flow meter while the fluid is in multi-phase form; determining a value of at least one physical characteristic from the measurement; and adjusting the injection gas characteristic based on the determined value, the adjustment tending to quickly improve well system production by elabling decisions to be made using real-time output values. In accordance with the invention, a system for monitoring the operation of a production well on gas-lift or similar artificial lift operation is provided wherein certain properties of the production fluid flowing through the tubing string are determined by sensing such parameters as pressure, density, flow rate, permittivity and conductivity. Signals related to values of these parameters are then sent to a controller used to adjust injection gas volumes to increase production of the fluid from the well.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals and wherein.

DESCRIPTION OF THE PREFERRED EMBODIMENTS

Figure 1:
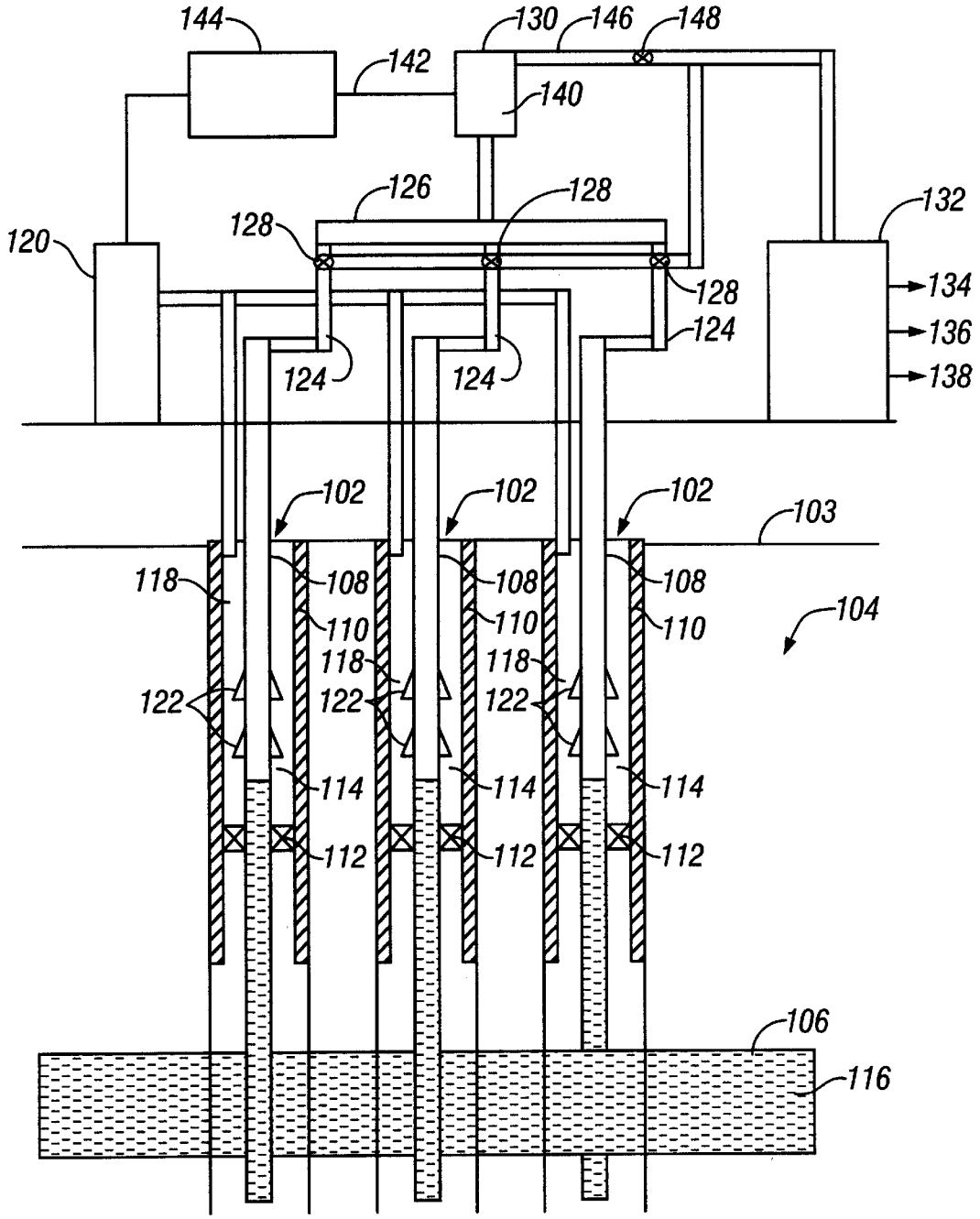
FIG. 1 is an elevation cross-section view of a gas-lift production well system according to the present invention.

FIG. 1 is an elevation cross-section view of a gas-lift production well system according to the present invention. Multiple wells 102 are drilled through subterranean formations 104 to reach one or more fluid-producing reservoirs 106. Each well 102 is completed with a production tubing 108 and well casing 110. The wells 102 may be high or low pressure land wells, or the wells 102 may be off-shore wells as shown with the production tubing 108 leading from the sea floor 103 to surface production equipment. Fluid barriers (packers) 112 are installed in an annular space (annulus) 114 between the production tubing 108 and well casing 110 to ensure that the recovered formation fluid 116 produced from the reservoirs 106 reaches the surface via the production tube 108 rather than the annulus 114. The recovered formation fluid at the surface may be liquid (e.g. water and product oil), gas, or multi-phase, whereas at downhole pressures, they are more likely to be in liquid state. The term formation fluid as used herein is intended to cover these possibilities.

Gas 118 is injected into the annulus 114 of each well 102 by a gas injection unit 120. The gas 118 enters the production tube 108 above the packers 112 via one or more openings 122 typically via gas-lift valves located in side pocket mandrels. The gas 118 mixes with formation fluid 116 and increases the pressure in the production tubing 108 thereby adding lift (reducing hydrostatic pressure) to the formation fluid 116. The additional lift provided by the injected gas 118 brings the formation fluid 116 to the surface.

At the surface, several production pipes 124 connect the production tubes 108 to a header manifold 126. Valves 128 mounted in the manifold 126 control whether the produced fluid 116 flows through a measuring device 130 or directly to a typical separator or production facility 132. The production facility 132 separates the formation fluid 116 into gas 134, oil 136 and water 138 or into gas and an oil and water mixture.

The measuring device 130 or a multi-phase meter 140 (to be described in detail later), is used to measure characteristics of the formation fluid 116 produced from the wells 102 and directed to the meter 140 via the valves 128 and header manifold 126. The measurements made by the meter 140 are passed through a wiring interface 142 to a gas controller and gas injection manifolds 144, while the formation fluid 130 flows on to the production facility 132 via a meter output pipe 146. A normally open shutoff valve 148 is usually installed in the meter output pipe 146, and is a well known safety feature in a producing well system. Valves 128 and 148 are primarily used to isolate the multi-phase meter from the well production from other wells and are required for multi-phase meter maintenance.

The gas controller 144 processes data received from the meter 140 real or near real-time and uses this information to adjust the gas injection rate from the injection unit 120. The adjustment to the gas injection unit 120 can greatly increase the efficiency of the well production system. Tests have demonstrated significant improvement in the production efficiency of some wells. Higher production efficiency in wells has the desirable effect of increasing and accelerating well production volumes and leads to lowering the operating cost of production.

The following tables illustrate the effect of controlling well production using known methods (TABLE 1), using the apparatus and methods of the present invention (TABLE 2) and the difference between the two (TABLE 3). Each table includes a well identification, production rate in barrels per day (bpd) of oil and water, produced gas and the injection rate used in thousand standard cubic feet per day (mscfd).

TABLE 1

| WELL | OIL (bpd) | WATER (bpd) | GAS (mscfd) | INJ GAS (mscfd) |
|---|---|---|---|---|
| 1 | 58.25 | 643.25 | 938.75 | 593.75 |
| 2 | 51.44 | 578.33 | 450.00 | 260.00 |
| 3 | 203.30 | 939.80 | 704.20 | 336.90 |
| 4 | 44.14 | 6.71 | 96.57 | 0.00 |
| 5 | 62.00 | 790.62 | 428.25 | 345.00 |
| 6 | 121.63 | 481.75 | 348.00 | 200.80 |
| 7 | 131.50 | 399.90 | 366.60 | 273.80 |
| 8 | 136.85 | 639.00 | 950.50 | 507.00 |
| 9 | 129.70 | 606.70 | 365.40 | 201.80 |
| 10 | 294.00 | 317.70 | 596.60 | 454.40 |
| 11 | 115.20 | 583.20 | 352.50 | 356.80 |
| TOTAL | 1348.01 | 5986.96 | 5597.37 | 3530.25 |

TABLE 2

| WELL | OIL (bpd) | WATER (bpd) | GAS (mscfd) | INJ GAS (mscfd) |
|---|---|---|---|---|
| 1 | 61.00 | 581.50 | 555.00 | 472.00 |
| 2 | 48.70 | 503.30 | 190.70 | 166.90 |
| 3 | 184.00 | 992.00 | 622.00 | 237.00 |
| 4 | 39.60 | 9.70 | 65.80 | 0.00 |
| 5 | 79.50 | 1063.70 | 511.00 | 496.00 |
| 6 | 217.60 | 810.70 | 644.70 | 339.30 |
| 7 | 239.60 | 674.16 | 341.40 | 202.40 |
| 8 | 163.00 | 662.60 | 511.00 | 541.70 |
| 9 | 201.10 | 890.50 | 329.50 | 294.80 |
| 10 | 278.00 | 350.60 | 354.40 | 283.30 |
| 11 | 208.45 | 1241.00 | 522.50 | 512.20 |
| TOTAL | 1720.55 | 7779.76 | 4648.00 | 3545.60 |

TABLE 3

| WELL | OIL (bpd) | WATER (bpd) | GAS (mscfd) | INJ GAS (mscfd) |
|---|---|---|---|---|
| W/O MPFM | 1348.01 | 5986.96 | 5597.37 | 3530.25 |
| W/ MPFM | 1720.55 | 7779.76 | 4648.00 | 3545.60 |
| DIFF | 372.56 | 1793.00 | −949.00 | 15.00 |

The preceding tables illustrate several important aspects of the present invention. First, the production of the product of interest i.e. oil, is significantly increased. Secondly, the increase is not necessarily based on increased injection rates. To the contrary, decreasing injection gas rates sometimes increases production.

There is a net decrease in produced gas from the wells. However, those versed in production would recognize that the relative amount of increase on oil production far outweighs the negligible reduction in produced gas.

Figure 2:
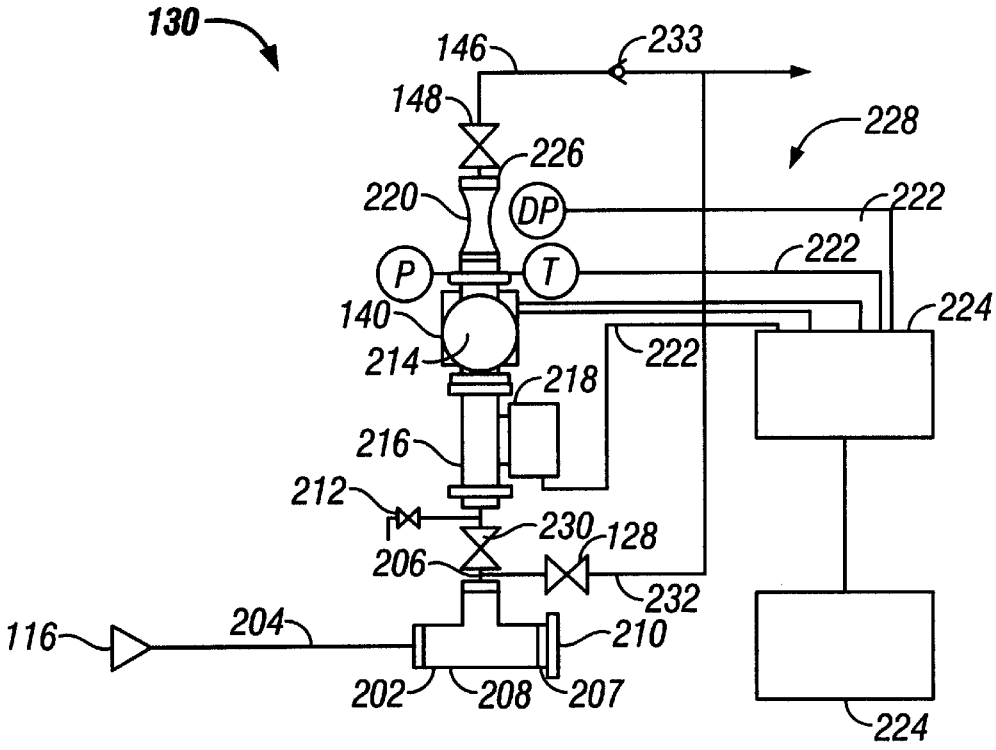
FIG. 2 is an elevation view of a typical arrangement of a measuring device that could be used in the system of FIG. 1.

FIG. 2 is an elevation view of one typical type of multi-phase measuring device 130 of FIG. 1. In this type of multi-phase measuring system, a pipe connector 202 known as a "blinded T" connects a horizontal well production pipe or manifold output pipe 204 to a vertical test pipe 206 leading to a multi-phase meter 140. The "blinded T" connector has a short (approximately 6 inches) portion of pipe 208 and a cap 210 for sealing an end 207 of the connector 202. The capped portion of the connector 202 induces turbulence in the fluid flowing into the connector 202. The turbulence ensures a more natural flow of recovered formation fluid in entering the vertical test pipe 206 and the multi-phase meter 140. Using a vertical test pipe 206 leading into the multi-phase meter 140 reduces the likelihood of separation of the formation fluid 116 prior to measurement. A sample valve 212 mounted on the vertical test pipe 206 allows for manual sampling of formation fluids 116 prior to the fluids entering the multi-phase meter 140.

The multi-phase meter 140 may comprise a plurality of sensors for sensing various characteristics of the formation fluid flowing through the multi-phase meter 140. A gamma densitometer 214 using cesium 137 as a radioactive source or other suitable device may be used to measure the instantaneous total density of formation fluid flowing in the pipe 206. A capacitance sensor 216 or other suitable device may be used to sense the permittivity of the formation fluid when oil-continuous flow is automatically determined. An inductive sensor 218 or other suitable device may be used to measure electrical conductivity of the formation fluid when water-continuous flow is automatically determined. A venturi meter 220 measures the flow rate of the formation fluid by sensing the pressures entering and exiting the venturi meter 220. It is preferable that the multi-phase meter 140 be as non-intrusive on the fluid flow as possible. It is also desirable that the multi-phase meter 140 be an integrated unit for ease of integration into the overall well system. One such multi-phase meter is sold under the trade name Fluenta MPFM 1900 VI™ available from Fluenta AS of Norway. The Fluenta MPFM 1900 VI was used in tests of the present invention, and it was found to be highly accurate. However, it was also determined that the high accuracy of the Fluenta MPFM 1900 VI was not necessary for obtaining valuable and useful information for controlling a well system according to the present invention.

Therefore, it is possible to utilize alternative designs with their own unique processes and typical multi-phase meters and still realize the full benefit of the invention.

The various sensors used in a typical multi-phase meter 140 send electronic output signals via conductors 222 through a wiring interface 112 and then on to a flow computer 224. The flow computer 224 processes inputs indicative of fluid characteristics such as pressure, temperature, delta pressure, fluid density, conductivity, permittivity, and flow rate to determine the fluid components and to provide information for controlling characteristics of the injection gas 118 used to lift the formation fluid 116. The output of the flow computer 224 may be used to automatically control the well system by sending the output directly to a controller 144 (see FIG. 1) via the wiring interface 112. The flow computer 224 may also be used to output the information to a display or printout to be viewed by operating personnel and production engineers. The information may also be sent to a storage device for record keeping, historic trending or other future analyses. Well production efficiency can be increased using any of these output techniques, because control decisions are made using real-time values rather than averaged values. These output devices are well known and thus are not shown or described in detail.

Leading from the multi-phase meter 140 down stream toward the separator (see FIG. 1) is a typical normally open shutdown valve 148. This valve is a safety device well known in the art. The shutdown valve 148 is connected to a multi-phase meter output 226 and to an output pipe 146 that leads to the separator.

It is necessary to consider maintenance of the multi-phase meter 140 during production. A meter bypass section 228 is used to allow continued production when the multi-phase meter 140 requires maintenance or whenever it may be desirable to cease measuring while maintaining fluid flow to the separator. A block valve 230 installed in the vertical test pipe 206 is used to divert fluid flow to the bypass section 228. The bypass section 228 further comprises a bypass valve 128 leading from the test pipe 206 to a bypass pipe 232. The bypass pipe 232 connects to the output pipe 146 down stream of the shutdown valve 148. The bypass valve 128 may be utilized to perform the function of the shutdown valve 148 while the shutdown valve 148 is bypassed. A check valve 233 should be installed in the output pipe 146 to prevent fluid from flowing back through the multi-phase meter 140 when using the bypass pipe 232.

Figure 3:
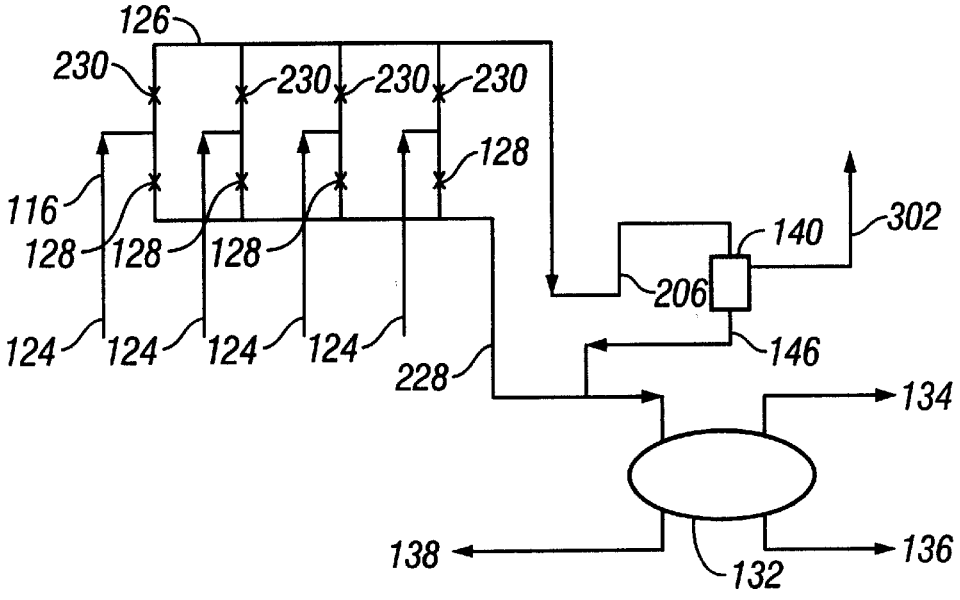
FIG. 3 is a system schematic of an embodiment of the present invention.

FIG. 3 is a system schematic of an embodiment of the present invention. Production pipes 124 flow formation fluid 116 from a plurality of wells to a header manifold 126. The manifold 126 further comprises block valves 230 and bypass valves 128 for controlling the direction of flow from each production pipe 124 to either a bypass section 228 or to a multi-phase meter 140.

The multi-phase meter 140 measures characteristics of the formation fluid as described above. An output 302 from the meter 140 such as an electronic digital or analog signal is transmitted to a suitable output device such as a display unit, printer or to a control unit for automatic control of the well based on the meter output.

Fluid selected to be measured flows through a production pipe 124 to a vertical test pipe 206. The fluid then flows through a multi-phase meter 140 as described above. The fluid leaving the multi-phase meter 140 flows through an output pipe leading to a production facility 132. The production facility 132 separates the multi-phase fluid into its constituent parts of gas 134, oil 136 and water 138 or into gas and water mixed with oil.

As discussed above, other multi-phase meters could be used. In an alternative embodiment, a meter such as a Megra™ multi-phase flow meter, produced by Daniel® Inc., is used rather than the Fluenta meter. The Megra meter is more intrusive in the flow line, but serves the purpose of this invention.

Having described an apparatus according to the present invention, a method of producing multi-phase formation fluids using a gas-lift well system can now be described. One or more producing wells in a formation requiring gas-lift techniques to facilitate production are completed, and production is commenced. A gas is injected into an annulus existing between a production pipe and a borehole wall at a predetermined pressure and rate using a gas injection unit. The gas enters the production pipe from the annulus through one or more mandrels and provides a force (reduces hydrostatic pressure) in addition to normal formation fluid pressure to lift the formation fluid to the surface.

A header manifold is used to select formation fluid from a particular well when multiple wells are included in the system. Formation fluid is routed from each well to the manifold. Valves in the manifold as described above and shown in FIG. 3 are used to select produced formation fluid from at least one of the wells for measurement with a multi-phase meter.

Produced formation fluid is measured using a multi-phase meter to determine characteristics of the formation fluid such as fluid pressure, relative density and flow rate. If the fluid is multi-phase, characteristics of the constituent parts of the multi-phase fluid such as oil or water-continuous flow, gas flow rate, oil slug flow rate, slug density, water content etc . . . are then determined. Immediately upon determining the characteristics, the gas injection into the well is adjusted based on the above-described determinations and the adjusted gas is injected into the well to improve revenue-generating production.

Additional advantages may be realized by flowing the multi-phase formation into a multi-phase meter oriented in a vertical position. This helps ensure the formation fluid remains as a multi-phase mixture during measurement. Also helpful in ensuring the fluid remains in multi-phase form is inducing turbulence in the mixture prior to flowing the mixture through the multi-phase meter. Turbulence may be induced by flowing the multi-phase through a 90 deg connector known as a "blinded T" as described above.

Well production is improved in another method according to the present invention by improving gas-lift valve position i.e. determining the a more efficient location of gas-lift valves and the position of valve plugs known as "dummy valves". Those versed in the art understand that a typical production tube has predetermined locations defined for valve placement. Gas-lift valves are typically needed only near the surface in the early stages of well production. As the well ages, gas must be injected deeper into the well due to reducing formation pressure. Therefore, valve locations deep in the well are initially fitted with dummy valves to prevent migration of tube fluid to the outside of the tube. Known tools are used to replace dummy valves with gas-lift valves as the need arises to inject gas into the tube at a deeper location.

Instantaneous measurements are taken using measurements and apparatus as described above when gas-lift valves are positioned or repositioned in the production tube. Values of the measurements are then used to understand in real-time the effect on production caused by moving the gas-lift valve. The values taken at several positions enable positioning of the gas-lift valves at a more productive location. Continued or periodic monitoring thereafter may be used to indicate the need to reposition the gas-lift valves.

The measurements and apparatus described above are used in another method according to the present invention to determine existence and approximate location of one or more holes in production tubing. Holes in production tubing can lead to various undesirable effects such as well washout, loss of production fluid and shortened life of the well. The method has the advantage of reducing or eliminating these undesirable effects by providing information useful in determining corrective action.

The production tubing may be associated with a single well or multiple wells leading to a header as described above and shown in FIGS. 1 and 3. In a preferred method, a known fluid is injected into an annulus existing between an exterior of the production tube and a well wall. Characteristics such as injection rate, density, volume, etc are preferably predetermined or these characteristics may be measured before or during injection. One or more openings such as gas-lift valves described above and shown in FIG. 1 are used to flow the fluid into the production tubing of a selected well. The injected fluid is combined with fluid produced from the well and the mixed fluid flows to the surface as a return fluid.

A multi-phase flow meter such as the meter described above and shown in FIG. 2 is used to make instantaneous multi-phase measurements of one or more characteristics of the return fluid e.g. pressure, delta pressure, fluid density conductivity, permittivity, and flow rate. The known initial values of the injection fluid and the measured values of the return fluid are then combined and analyzed to determine the existence and approximate location of the hole. More specifically, inflow and outflow measurements are analyzed to determine fluid loss, thereby indicating a hole in the tube that could cause one or more of the undesirable effects described above. Density measurements, used in conjunction with the flow measurements are indicative of the approximate location of the hole i.e. depth. These analyses may be accomplished using a processor and techniques known in the art. An advantage of the present method over typical methods currently used is that the method of the present invention provides information based on real-time values rather than information based on averaged and delayed values. The use of real-time values facilitates efficient implementation of corrective actions.

Another embodiment of the present invention is used to control chemical additives in a process known as dosing. This embodiment can best be explained by way of example. One such chemical used in production operations is Glycol. As is well known in the art, Glycol is used to control hydration as fluid is produced from the well. Glycol is quite expensive, and the present method reduces waste by enabling efficient use of Glycol.

Controlling subsea Glycol additives in the injection gas is accomplished by measuring well flow rate and relative density of the fluid flowing in the tubing are determined using measurement methods and apparatus as described above. The measurements are analyzed to determine parameters such as temperature, pressure or flow rate at a particular time. The determination is used to adjust Glycol dosing (injection mixture) so that only enough Glycol is used for hydrate inhibition. Typical methods waste expensive Glycol by overdosing, which is dosing beyond the point necessary for effective use. The instantaneous measurements provided by the present invention and subsequent control of Glycol input reduces cost of operating the well.

Figure 4:
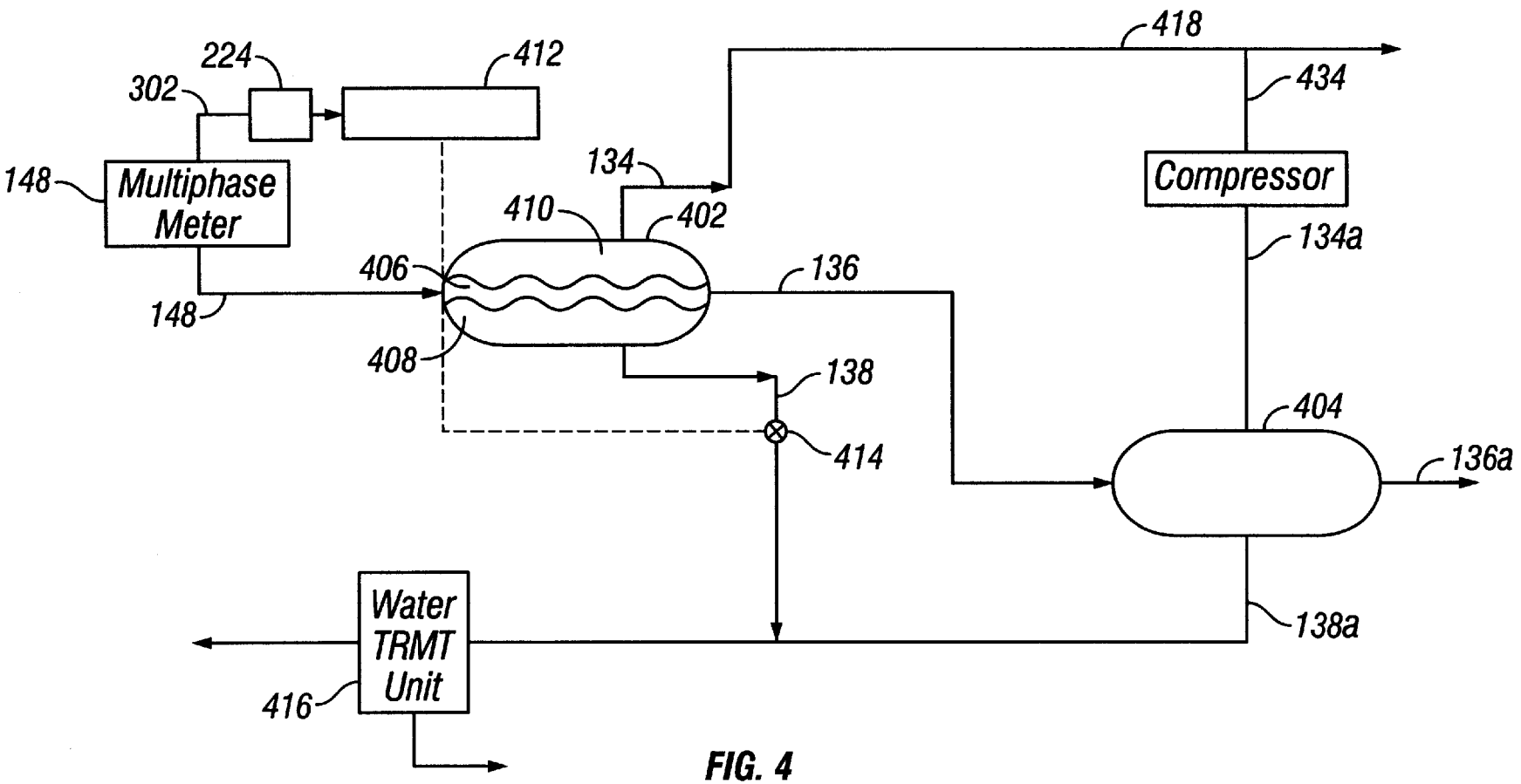
FIG. 4 is a system schematic of another embodiment of the present invention for water treatment.

FIG. 4 is a system schematic of another embodiment of the present invention. Conventionally, the separation of the produced fluid into its constituent parts is done in a series of three-phase separators 402, 404. Each separator, 402, 404, is at a successively lower pressure. An oil layer 406, forms in these separators on top of a water layer 408. The water 138 is extracted from the bottom of the three-phase separators 402, 404; the oil 136, from the middle portion; and the gas 134 from the top. The water from the produced fluid must be treated to remove residual oil, before it can be discharged. In the Untied States, regulatory agencies, such as the EPA or an individual state, may set the discharge criteria, which is usually expressed as parts-per-million (ppm) of oil in the water. An output 302 from the multi-phase meter 140 may be input into a flow computer 224. The flow computer may then calculate the flow rate of the water in the produced fluid. This calculated water flow rate may be used as an input into an automatic control system. 412. The automatic control system 412 may use a variety of conventional control methods (e.g., feed forward, cascade, multivariable, or model based controller) to adjust at least one water treatment unit control parameters (e.g., water feedrates, levels, recycle rates and air or oxygen rates for floatation systems). A preferred embodiment of the invention would vary the water feed rate into the water treatment unit 416. Conventional water treatment units may include corrugated plate units, hydroclones, and the like, which are well known in the art and are not shown or described in detail.

Still in looking at FIG. 4, another aspect of the invention may use the multi-phase meter 140 to input into the flow computer 224 to provide an input to the control system 412 to use in controlling a gas gathering system 420. The automatic control system 412 may use a variety of conventional control methods (e.g., feed forward, cascade, multivariable, or model based controller) to adjust at least one gas gathering system control parameter. A preferred embodiment of the invention would vary the pressure of the gas gathering system. Another embodiment could vary recycle rates or flow rates of any gas compressors used in the gas gathering system.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention. It is intended that the following claims be interpreted to embrace all such modifications and changes.

What is claimed is:

1. A method of controlling production from a gas-lift production well system including at least one well, the method comprising:

(a) injecting gas into the at least one well with a gas injection unit to lift formation fluid from the at least one well through production tubing;

(b) determining a value of at least one characteristic of formation fluid as the formation fluid is produced using a multi-phase flow meter; and (c) adjusting at least one injection gas characteristic based on the determined value, the adjustment tending to improve well system production.

2. The method of claim 1 wherein said adjusting at least one gas characteristic is performed substantially instantaneously after said determining a value of at least one characteristic.

3. The method of claim 1 further comprising flowing the formation fluid through a vertical pipe, the multi-phase meter being disposed on the vertical pipe.

4. The method of claim 2 further comprising flowing the formation fluid through a blinded T connector prior to flowing the formation fluid through the vertical pipe.

5. The method of claim 1 further comprising changing a gas-lift valve position based on the at least one formation fluid characteristic value.

6. The method of claim 1 wherein, said determining a value of at least one characteristic further comprises determining flow rate and relative density of the formation fluid and said adjusting at least one injection gas characteristic further comprises adjusting a dosing of a Glycol additive.

7. The method of claim 1 wherein determining a value of the at least one characteristic of the formation fluid further comprises at least one of:

(i) measuring permittivity of the fluid with a capacitance meter;

(ii) measuring conductivity of the fluid with an inductive sensor;

(iii) measuring total density of the fluid flowing in the production tube with a gamma densitometer;

(iv) measuring flow rate of the fluid in the production tube with a venturi meter; and (v) determining an oil production rate.

8. The method of claim 1 further comprising determining whether the formation fluid flow is oil-continuous or water-continuous.

9. The method of claim 8 further comprising:

(A) determining the permittivity of the formation fluid with a capacitance meter when the formation fluid flow is oil-continuous; and (B) determining the conductivity of the formation fluid with an inductance sensor when the fluid formation flow is water-continuous.

10. The method of claim 7 wherein said at least one characteristic is total density and further comprising using cesium 137 as a radioactive source in said gamma densitometer.

11. The method of claim 1 wherein the at least one well further comprises a plurality of producing wells, the method further comprising:

(i) routing formation fluid from each well of the plurality of producing wells through a header manifold input; and (ii) using the header manifold to select formation fluid produced from at least one of the plurality of producing wells before determining said value.

12. The method of claim 1 further comprising flowing the produced multi-phase fluid through a pipe to a separator and separating the multi-phase fluid into gas, oil and water.

13. The method of claim 11 further comprising:

(A) selecting multi-phase fluid from at least one of the plurality of wells to measure using a valve;

(B) routing the multi-phase fluid from wells not selected for measurement directly to a separator using a second valve.

14. A method of determining existence and approximate location of a hole in at least one of a plurality of production tubes of a gas-lift production well system including at least one well, the method comprising:

(a) injecting a known fluid into an annulus existing between an exterior of the at least one of a plurality of production tubes and a well wall, the known fluid having at least one characteristic, the at least one characteristic having a predetermined first value;

(b) flowing the known fluid from the annulus into to at least one of a plurality of production tubes through a plurality of valves disposed in the at least one of a plurality of production tubes;

(c) flowing a return fluid to a surface location through the at least one of a plurality of production tubes, the return fluid including the known fluid and multi-phase fluid produced from the at least one well;

(d) determining a second value of the at least one characteristic of the return fluid as using a multi-phase flow meter while the fluid is in multi-phase form; and (e) determining a third value based on the first value and second value, the third value indicative of the existence and approximate location of the hole.

15. A method of controlling a water treatment unit comprising:

(a) determining a value for a water rate from a formation fluid using a multi-phase flow meter;

(b) inputting the value to a control system; and (c) adjusting at least one water treatment unit control parameter.

16. The method of claim 15 wherein the water treatment unit control parameter adjusted is a water feedrate.

17. A method of controlling a gas gathering system comprising;

(a) determining a value for the produced gas rate from the formation fluid using a multi-phase flow meter;

(b) inputting the value to a control system; and (c) adjusting at least one gas gathering system control parameter.

18. The method of claim 17 wherein the gas gathering system control parameter is pressure.

19. An apparatus for producing multi-phase formation fluid from a well system including at least one well, the apparatus comprising:

(a) a production tube extending into the at least one well, the production tube and the at least one well having an annulus between the production tube and the at least one well;

(b) a meter disposed on the production tube, the meter being adapted for measuring at least one characteristic of formation fluid produced through the production tube;

(c) a gas controller coupled to the meter for processing said measured characteristic; and (d) a gas injection unit controlled by said gas controller to inject a gas into the annulus for facilitating production of the formation fluid; and (e) a plurality of valves disposed on the production tube and within the at least one well for allowing communication between the gas in the annulus and the multi-phase formation fluid flowing in the production tube.

20. The apparatus of claim 19 wherein the meter is capable of providing an output substantially instantaneously upon measuring the at least one characteristic.

21. The apparatus of claim 19 wherein the meter further comprises at least one of:

(i) a capacitance meter;

(ii) an inductive meter;

(iii) a gamma densitometer; and (iv) a venturi meter.

22. The apparatus of claim 21 wherein the meter comprises a gamma densitometer including cesium 137 radioactive material.

23. The apparatus of claim 19 wherein the at least one well further comprises a plurality of wells and the apparatus further comprises a header manifold connected to the production tubes of the plurality of wells for controlling flow to the meter.

24. The apparatus of claim 23 further comprising a separator connected to receive formation fluid flowing from the meter, the separator for separating the formation fluid into at least two of gas, oil and water.

25. The apparatus of claim 24 further comprising a meter bypass section having a bypass pipe connecting the header manifold output pipe to the meter output pipe.

26. The apparatus of claim 25 further comprising a first valve associated with at least one of the plurality of wells, the first valve disposed in the header manifold for selecting the multi-phase formation fluid to flow to the meter, and a second valve associated with the at least one of the plurality of wells for selecting formation fluid to flow through the bypass pipe.

27. The apparatus of claim 19 wherein the meter is located on a vertical section of the production tube.

28. The apparatus of claim 27 wherein the production tube further comprises a blinded T connector, and wherein the vertical section is connected to the blinded T connector.

* * * * *